US005904624A

United States Patent [19]

Martinez

[11] Patent Number: 5,904,624

[45] Date of Patent: May 18, 1999

[54] GOLF PUTTER TRAINER

[76] Inventor: Morris P. Martinez, 1705 E. 39th Ave., Denver, Colo. 80205

[21] Appl. No.: 09/028,907

[22] Filed: Feb. 24, 1998

[51] Int. Cl.[6] ..... A63B 69/36

[52] U.S. Cl. ..... 473/212; 473/276; 473/227; 473/206; 273/DIG. 30

[58] Field of Search ..... 473/206, 212, 473/213, 214, 276, 227

[56] References Cited

U.S. PATENT DOCUMENTS 5,203,568 4/1993 Vasquez ..... 473/212
5,259,621 11/1993 Keefer ..... 473/212

*Primary Examiner*—George J. Marlo
*Attorney, Agent, or Firm*—Edwin H. Crabtree; Ramon L. Pizarro; Donald W. Margolis

[57] ABSTRACT

A golf putting trainer adapted for releasable attachment to a golf putter and for folding neatly into a storage position and placing in a golf bag when the training is completed. The golf putting trainer includes a "U" shaped grip support having a lower grip arm with strap for wrapping around a lower portion of a golf putter grip and an upper grip arm for engaging a butt end on an upper portion of the golf putter grip. A wrist swivel with wrist swivel adjustment nut is mounted on the upper grip arm. A lower end of a height adjustment rod is pivotly attached to the wrist swivel and secured thereto using a pivot adjustment nut. An upper end of the height extension rod is slidably received in a lower end of a height extension tube and secured thereto using a height extension nut. A forearm swivel tube is pivotly mounted on an upper end of the height extension tube and secured thereto using a forearm swivel nut. One end of a right forearm extension arm is slidably received in the forearm swivel tube and secured thereto using a right forearm adjustment nut. Also, one end of a left forearm extension arm is slidably received in the forearm swivel tube and secured thereto using a left forearm adjustment nut. A right forearm cup is mounted on an opposite end of the right forearm extension arm. A left forearm cup is mounted on an opposite end of the left forearm extension arm. The right forearm cup and the left forearm cup are used to engage the forearms of the golfer and lock the forearms in place to prevent movement during the putting stroke.

11 Claims, 2 Drawing Sheets

GOLF PUTTER TRAINER

BACKGROUND OF THE INVENTION (a) Field of the Invention This invention relates to golf training devices and more particularly, but not by way of limitation, to a golf putting trainer used with a golf putter for greatly improving a golfer's putting stroke.

(b) Discussion of Prior Art

In the world of golf, there are great number of teaching and training aids for helping both amateur and professional golfers improve their golf club swing and putting stroke. U.S. Pat. No. 4,944,516 to Bickler discloses a golf putting aid. This patent describes a "V" shaped brace which inserts into the top of a putter. The "V" shaped brace helps keep a putter's wrist in a locked position for a pendulum stroke. Also, there is currently on the golf accessory market a putting aid called the "Kortis Krutch". This device goes between the golfer's forearms and snaps onto the putter for helping provide a consistent stroke. The "Kortis Krutch" has similar features to the subject invention but does not provide the combination of the structural features, objects and advantages as described herein and for providing what is considered a perfect putting stroke. Further, there is for sale a putting aid called the "Master Putt". The Master Putt provides a large "T" shaped device which goes under the golfer's arms and is attached to the putter. The device is designed to help the golfer with a perfect pendulum stroke. Still another putting device is available and called a "Putting Connection". The Putting Connection is a brace which is held between a players biceps. The brace helps lock the golfer's arms to ideally provide a pendulum stroke.

The subject golf putting trainer provides a unique putting stroke device which is releasably attached to a golf putter and used when practicing putting strokes. The trainer can be also be quickly folded neatly into a storage position for placing in a golf bag when putting practice is completed. None of the prior art putting aids and devices provide the unique structure and function of the subject putting trainer as described as follows.

SUMMARY OF THE INVENTION

In view of the foregoing, it is a primary object of the subject invention is to provide a golf putting trainer that can be quickly attached to a golfer's putter for use in putting practice and developing a perfect putting stroke. The perfect putting stroke being defined herein as a stroke used by a majority of the best touring golf professionals and being a movement of shoulders and arms only with firm wrists gripping the putter. The rest of the golfer's body such as the putter's legs, knees, hips, waist and head are held in place during the stroking of the golf ball. The subject putting trainer helps create the perfect shoulder motion with firm wrists during the putting stroke.

Another object of the golf putting trainer is it's adaptability to a person's normal putting position at the hands and the forearms. Also, the putting trainer can be quickly adjusted to golfers of various body sizes, arm lengths and heights.

Yet another feature of the invention is the putting trainer can be folded neatly into a compact unit for storing in a golf bag when not used for putting practice.

Still another object of the invention is the putting trainer lets the golfer feel his or her shoulders move and the firm wrists stroke the golf ball. This is exactly what the best golf putters feel.

The golf putting trainer includes a "U" shaped grip support having a lower grip arm with strap for wrapping around a lower portion of a golf putter grip of a golf putter and holding the grip support thereon. Also the grip support includes an upper grip arm for engaging a butt end on an upper portion of the golf putter grip. A wrist swivel with wrist swivel adjustment nut is mounted on the upper grip arm. The wrist swivel can be secured in place so that there is no swivel of the golfer's wrist during the putting stroke or the wrist swivel adjustment nut can be loosened slightly so that there is slight movement of the golfer's wrist during a long putting stroke.

A lower end of a height adjustment rod is pivotly attached to the wrist swivel and secured thereto using a pivot adjustment nut. The pivot adjustment nut allows the golf putting trainer to be adjusted toward the golfer's body or away from the golfer's body depending on the person's normal putting position. An upper end of the height extension rod is slidably received in a lower end of a height extension tube and secured thereto using a height extension nut. A forearm swivel tube is pivotly mounted on an upper end of the height extension tube and secured thereto using a forearm swivel nut. One end of a right forearm extension arm is slidably received in the forearm swivel tube and secured thereto using a right forearm adjustment nut. Also, one end of a left forearm extension arm is slidably received in the forearm swivel tube and secured thereto using a left forearm adjustment nut. The right and left forearm extension arms allow for adjustment of the distance between the forearms of different size golfers and different types of putting stances. A right forearm cup is mounted on an opposite end of the right forearm extension arm. A left forearm cup is mounted on an opposite end of the left forearm extension arm. The right forearm cup and the left forearm cup are used to engage the forearms of the golfer and lock the forearms in place to prevent movement during the golf putting stroke.

These and other objects of the present invention will become apparent to those familiar with golf training aids and training devices related to the art of golf putting from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
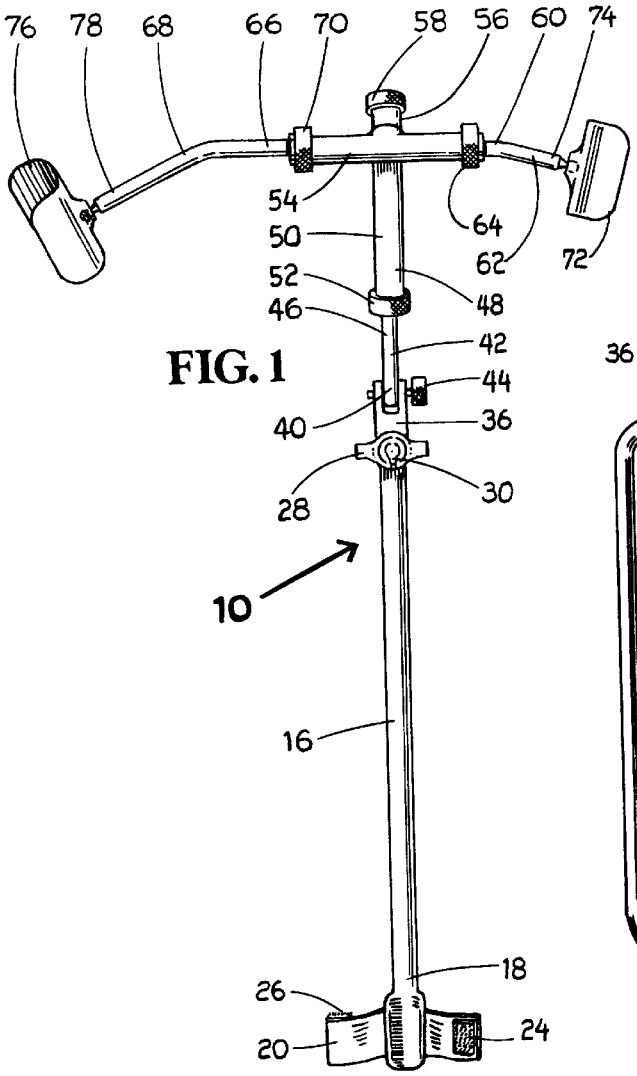
FIG. 1 is a front view of the subject golf putting trainer and positioned for mounting on a golf putter grip of a golf putter.
Figure 2:
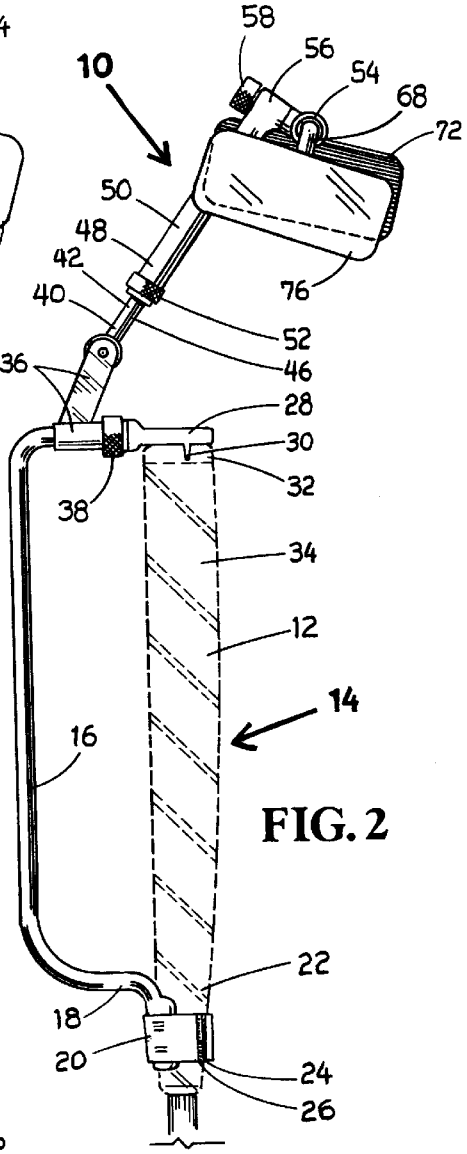
FIG. 2 is a side view of the golf putting trainer having a "U" shaped grip support releaseably attached to the golf putter grip of the golf putter. The golf grip is shown in dashed lines.

In FIGS. 1 and 2, a front view and a side view of the subject golf putting trainer is shown. The golf putting trainer is designated by general reference numeral 10. In FIG. 2, the putting trainer 10 is shown releasably attached to a golf putter grip 12 of a golf putter. The golf putter is designated by general reference numeral 14. The golf putter 14 is shown in dashed lines. For ease in describing the individual structure, the combination of structure and the function of the putting trainer 10, both FIG. 1 and FIG. 2 will be discussed together.

The golf putting trainer 10 includes a "U" shaped grip support 16 having a lower grip arm 18 with a flexible strap 20. The strap 20 is used for wrapping around a lower portion 22 of the golf putter grip 12 for holding the grip support 16 thereon. The strap 20 includes hook fasteners 24 on the front side of one end of the strap 20 and loop fasteners 26 on the back side of an opposite end of the strap 20. The hook fasteners 24 of the strap 20 are shown engaging the loop fasteners 26 in FIG. 2. The "U" shaped grip support 16 also includes an upper grip arm 28 having a downwardly extending tapered pin 30 for receipt in a hole in a butt end 32 on an upper portion 34 of the golf putter grip 12. By using the tapered pin 30 and the flexible strap 20 of the grip support 16, the subject golf putting trainer 10 can be quickly mounted on the golf putter 14 for practicing putting and developing a perfect putting stroke.

A wrist swivel 36 with wrist swivel adjustment nut 38 is mounted on the upper grip arm 28. The wrist swivel 36 can be secured in place by tightening the nut 38 on the upper grip arm 28 so that there is no swivel of the golfer's wrist during a short putting stroke. On the other hand, the wrist swivel adjustment nut 38 can be loosened slightly so that there is limited movement of the golfer's wrist during a long putting stroke.

A lower end 40 of a height adjustment rod 42 is pivotly attached to the wrist swivel 36 and secured thereto using a pivot adjustment nut 44. The pivot adjustment nut 44 allows the golf putting trainer 10 to be adjusted toward a golfer's body or away from the golfer's body depending on the person's normal putting position. An upper end 46 of the height extension rod 42 is slidably received in a lower end 48 of a height extension tube 50 and secured thereto using a height extension nut 52. By telescoping the length of the height extension rod 42 in the height extension tube 50, the golf putting trainer 10 can be adjusted for golfers of different height.

A forearm swivel tube 54 is pivotly mounted on an upper end 56 of the height extension tube 50 and secured thereto using a forearm swivel nut 58. One end 60 of a right forearm extension arm 62 is slidably received in the forearm swivel tube 54 and secured thereto using a right forearm adjustment nut 64. Also, one end 66 of a left forearm extension arm 68 is slidably received in the forearm swivel tube 54 and secured thereto using a left forearm adjustment nut 70. The right and left forearm extension arms 62 and 70 by telescoping in and out of the forearm swivel tube 54 and tightened thereon allow for adjustment of the distance between the forearms of different size golfers and different types of putting stances. Also note, that the left forearm extension arm 70 is longer than the right forearm extension arm 62 and the two arms 62 and 70 can be reversed on the forearm swivel tube 54 for either right or left hand golfers.

A right forearm semi-circular cup 72 is pivotly mounted using a ball joint on an opposite end 74 of the right forearm extension arm 62. A left forearm semi-circular cup 76 is mounted on an opposite end 78 of the left forearm extension arm 68. The right forearm cup 72 and the left forearm cup 76 are used to engage the forearms of the golfer and lock the forearms in place to prevent movement during the golf putting stroke. The forearm cups 72 and 76 may be made of rubber, flexible plastic and like materials for comfort when pressed against the forearms and for ease in flexing during the storage of the putting trainer 10. By loosing and then tightening the forearm swivel nut 58, the forearm cups 72 and 76 can be rotated to fit the golfer's forearm putting stance.

Figure 3:
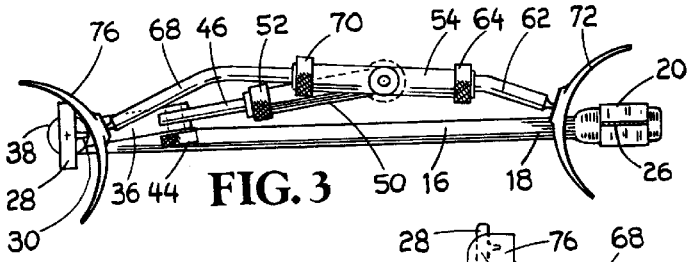
FIG. 3 is a top view of the golf putting trainer folded into a compact unit and ready for storage in a golf bag.
Figure 4:
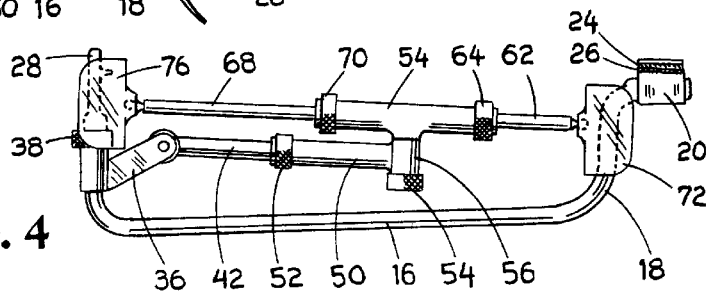
FIG. 4 is a side view of the golf putting trainer in a folded position as shown in FIG. 3.

In FIG. 3 and FIG. 4, a top view and a side view of the golf putting trainer 10 is shown folded into a compact unit and ready for storage in a golf bag when putting practice is completed. The putting trained 10 is folded quickly and neatly by first loosing the flexible strap 20 from around the lower portion 22 of the golf putter handle 12. The butt end 32 of the putter handle 12 is then removed from the tapered pin. The ends of the flexible strap 20 are attached to each other using the hook and loop fasteners 24 and 26. The wrist swivel adjustment nut 38 is then loosened and the wrist swivel 36 and the height adjustment rod 42 and height adjustment tube 50 are folded parallel to the length of the "U" shaped grip support 16. The forearm swivel nut 58 is then loosened and the forearm swivel tube 54 and the right and left extension arms 62 and 68 are folded parallel to the length of the "U" shaped grip support 16. The right forearm cup 72 is now resting against the lower grip arm 18 and the left forearm cup 76 is resting against the upper grip arm 28. In this manner, the golf putting trainer 10 is folded neatly into a compact storage unit for placing in the golf bag until it is again used for putting practice.

Figure 5:
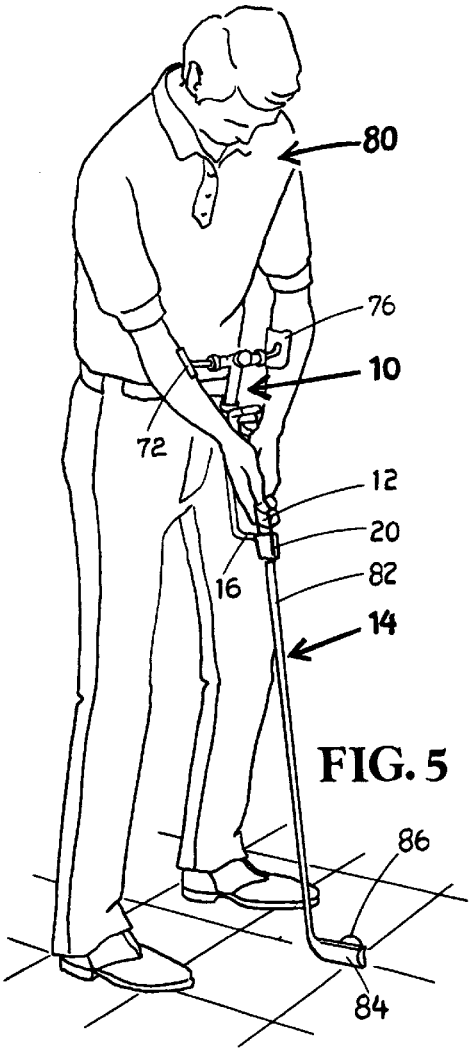
FIG. 5 is a perspective view of a right handed male golfer using the subject invention with his golf putter. A putter head of the golf putter is shown addressing a golf ball prior to stroking the golf ball.

In FIG. 5, a perspective view of a right handed male golfer, having general reference numeral 80, is shown using the subject invention with his golf putter 14. The golf putter 14 includes a putter shaft 82 and a putter head 84. The putter head 84 of the golf putter 14 is shown addressing a golf ball 86 prior to stroking the golf ball 86. In this drawing, the golfer's knees are slightly bent, his head and eyes are concentrated downward on the golf ball 86 and his forearms are held tightly against the forearms cups 72 and 76. The golfer's hands, using a traditional interlocking golf grip, are shown engaging the golf grip 12 with the wrists in a locked position.

Figure 6:
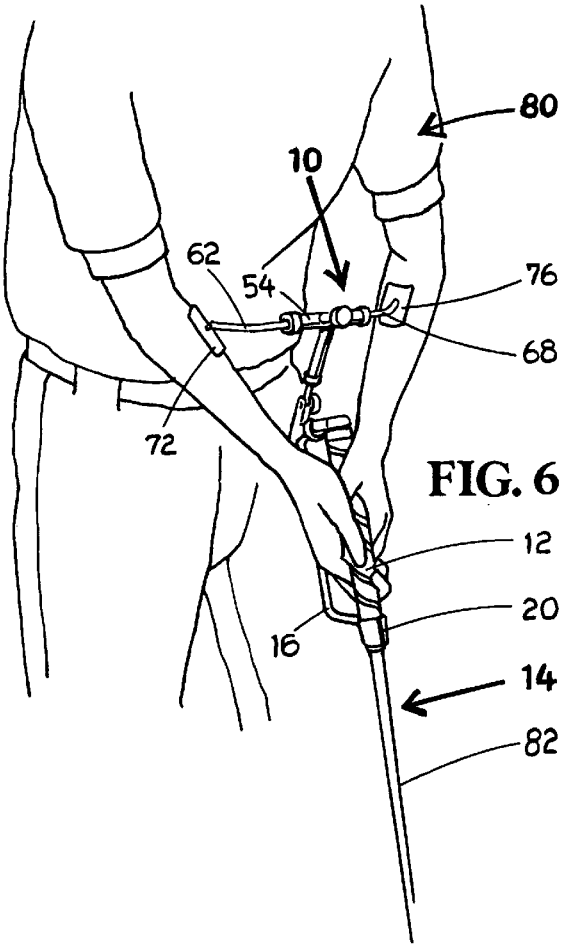
FIG. 6 is an enlarged perspective view of the golfer shown in FIG. 5. In this view, the golfer's forearms are shown engaging the forearm cups and the wrists in a locked position gripping the golf putter grip.

In FIG. 6, an enlarged perspective view of the golfer 80 is shown. In this view, the golfer's forearms are shown pressed against the forearm cups 72 and 76 with the forearm extension arms 62 and 68 adjusted on the forearm swivel tube 50 for the golfer's putting stance. Also, the height adjustment rod 42 has been adjusted in the height adjustment tube 50 for the golfer's height.

Figure 7A:
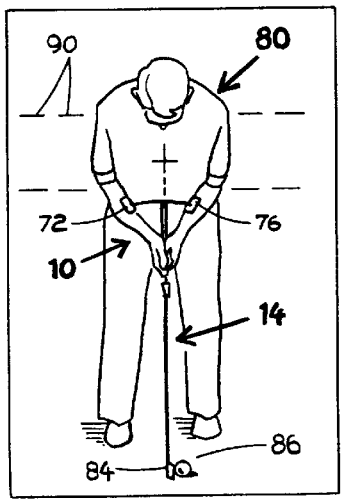
FIG. 7A illustrates a front view of the golfer shown in FIG. 5 with the golf putter trainer in use and the putter head addressing the golf ball prior to the golf stroke.

In FIG. 7A, the golfer 80 is shown with the golf putter 14 in a vertical position and the putter head 84 addressing the golf ball 86 prior to the golf stroke. The golfer's shoulders are shown squared and in a horizontal position as indicated by dashed lines 90 and perpendicular to the length of the golf putter 14. The forearms are shown pressed against the forearm cups 72 and 76.

Figure 7B:
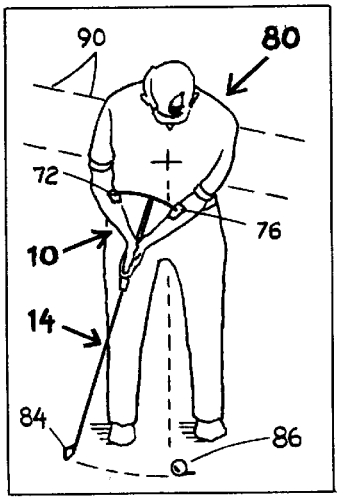
FIG. 7B illustrates a front view of the golfer with the golf putter in a back stroke and with the only movement of the golfer's body is his shoulders and arms.

In FIG. 7B, the golfer 80 is shown with the golf putter 14 in a back stroke with the only movement of the golfer's body being his shoulders and arms. As the golf putter 14 is moved in the back stroke, the shoulders move and remain perpendicular to the length of the golf putter 14. During this time there is no movement of the golfer's legs, knees, hips and waist. The golfer's head remains looking down with his eyes concentrated on the golf ball 86.

Figure 7C:
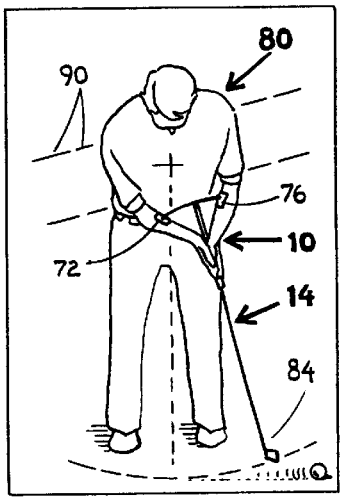
FIG. 7C illustrates a front view of the golfer with the golf putter completing the putting stroke and the putter head having engaged and hit the golf ball forward during what is considered a perfect putting stroke with only shoulder movement and the wrists locked in place during shorter putting strokes.

In FIG. 7C, the golfer 80 is shown completing the putting stroke with the putter head 84 having engaged and hit the golf ball 86 forward. Note in this drawing, the golfer's shoulders remain perpendicular to the length of the golf putter 14 as he completes the putting stroke. As mentioned above and during shorter putting strokes, the golfer's wrist remain in a locked position. For longer putting strokes, the wrist swivel 36 on the putting trainer 10 can be loosed for allowing a slight break of the wrists.

In the drawings FIGS. 7A, 7B and 7C, what is considered a perfect putting stroke is illustrated with only the golfer's shoulders and arms moving with the wrists locked in place when holding the golf putter grip 12. By using the above described invention and with regular putting practice, a golfer can greatly improve his or her putting technique with a goal of a lower golf score.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A golf putting trainer adapted for releasable attachment to a golf putter grip on a golf putter and used by a golfer for putting practice, the golf putting trainer also adapted for folding neatly into a storage position when placed in a golf bag when the practice is completed, the golf putting trainer comprising:

a grip support adapted for releasably attachment along the length of the golf putter grip;

forearm engagement mean for adjustably engaging the forearms of the golfer and disposed at an angle to a length of the said grip support; and wrist swivel means attached to said grip support and to said forearm engagement means and disposed therebetween, said wrist swivel means when tightened preventing movement during a short putting stroke, said wrist swivel means when slightly loosed allowing a fixed amount of swivel during a long putting stroke, said wrist means when completely loosened allowing said forearm engagement means to be folded next to said grip support when storing the golf putting trainer.

2. The golf putting trainer as described in claim 1 wherein said forearm engagement means includes a right forearm extension arm with a right forearm cup rotatably mounted there on and a left forearm extension arm with a left forearm cup rotatably mounted thereon, whereby said right forearm cup and said left forearm cup are adapted for and used to engage the forearms of the golfer and lock the forearms in place to prevent movement during a putting stroke.

3. The golf putting trainer as described in claim 1 further including a height adjustment means attached to said wrist swivel means for adjusting the height of the putting trainer for different golfer heights.

4. The golf putting trainer as described in claim 1 further including forearm swivel means mounted on said forearm engagement means for adjusting to a position of the golfer's forearms.

5. A golf putting trainer adapted for releasable attachment to a golf putter grip on a golf putter and used by a golfer for putting practice, the golf putting trainer also adapted for folding neatly into a storage position when placed in a golf bag when the practice is completed, the golf putting trainer comprising:

a "U" shaped grip support adapted for releasably attachment along the length of the golf putter grip;

forearm engagement means for adjustably engaging the forearms of the golfer and disposed at a right angle to a length of the said grip support, said forearm engagement means including an adjustable right forearm extension arm with a right forearm cup rotatably mounted on one end of said right forearm extension arm and an adjustable left forearm extension arm with a left forearm cup rotatably mounted on one end of said left forearm extension arm; and wrist swivel means attached to said grip support and to said forearm engagement means and disposed therebetween, said wrist swivel means when tightened preventing movement during a short putting stroke, said wrist swivel means when slightly loosed allowing a fixed amount of swivel during a long putting stroke, said wrist means when completely loosened allowing said forearm engagement means to be folded next to said grip support when storing the golf putting trainer.

6. The golf putting trainer as described in claim 5 further including a height adjustment means attached to said wrist swivel means and said forearm engagement means for adjusting the height of the putting trainer for different golfer heights.

7. The golf putting trainer as described in claim 5 further including forearm swivel means mounted on said forearm engagement means for adjusting to a position of the golfer's forearms.

8. A golf putting trainer adapted for releasable attachment to a golf putter grip on a golf putter and used by a golfer for putting practice, the golf putting trainer also adapted for folding neatly into a storage position when placed in a golf bag when the practice is completed, the golf putting trainer comprising:

a "U" shaped grip support adapted for releasably attachment along the length of the golf putter grip;

height adjustment means for adjusting the height of the putting trainer for different golfer heights;

forearm engagement means for adjustably engaging the forearms of the golfer, said forearm engagement means attached to said height adjustment means and disposed at a right angle to a length of the said grip support, said forearm engagement means including an adjustable right forearm extension arm with a right forearm cup rotatably mounted on one end of said right forearm extension arm and an adjustable left forearm extension arm with a left forearm cup rotatably mounted on one end of said left forearm extension arm; and a wrist swivel with wrist swivel adjustment nut, said wrist swivel attached to said grip support and to said height adjustment means and disposed therebetween, said wrist swivel adjustment nut when tightened preventing movement during a short putting stroke, said wrist swivel adjustment nut when slightly loosed allowing a fixed amount of swivel during a long putting stroke, said wrist swivel adjustment nut when completely loosened allowing said height adjustment means and said forearm engagement means to be folded next to said grip support when storing the golf putting trainer.

9. The golf putting trainer as described in claim 8 wherein said "U" shaped grip support includes a lower grip arm with a flexible strap, said flexible strap adapted for wrapping around a lower portion of the golf putter grip, said grip support having an upper grip arm, said upper grip arm adapted for engaging an upper portion of the golf putter grip.

10. The golf putting trainer as described in claim 8 wherein said height adjustment means includes a height adjustment rod pivotly attached to said wrist swivel and secured thereto using a pivot adjustment nut, said height extension rod slidably received in a height extension tube and secured thereto using a height extension nut.

11. The golf putting trainer as described in claim 10 wherein said forearm extension means includes a forearm swivel tube pivotly mounted on said height extension tube and secured thereto using a forearm swivel nut.

* * * * *